United States Patent [19]

Wilkinson

[11] Patent Number: 4,767,507

[45] Date of Patent: Aug. 30, 1988

[54] GOLD ELECTROPLATING BATH

[75] Inventor: Peter Wilkinson, Coleford, England

[73] Assignee: Engelhard Corporation, Menlo Park, N.J.

[21] Appl. No.: 144,607

[22] Filed: Jan. 11, 1988

Related U.S. Application Data

[63] Continuation of Ser. No. 37,766, Apr. 13, 1987, abandoned.

[30] Foreign Application Priority Data

May 21, 1986 [GB] United Kingdom ..... 8612361

[51] Int. Cl.[4] ..... C25D 3/48; C25D 3/62

[52] U.S. Cl. ..... 204/44.3; 204/44; 204/47.5

[58] Field of Search ..... 204/47.5, 44.3, 44

[56] References Cited

U.S. PATENT DOCUMENTS

| | | | |
|---|---|---|---|
| 3,901,773 | 10/1975 | Ludwig | 204/41 |
| 3,929,595 | 12/1975 | Biberbach et al. | 204/44 |
| 4,038,161 | 7/1977 | Eckles et al. | 204/52.1 |

FOREIGN PATENT DOCUMENTS

| | | | |
|---|---|---|---|
| 0150439 | 8/1985 | European Pat. Off. | 204/44.3 |
| 2237807 | 2/1974 | Fed. Rep. of Germany | 204/51 |
| 27527 | 12/1967 | Japan | 204/47.5 |
| 455434 | 7/1968 | Switzerland | 204/44.3 |

*Primary Examiner*—G. L. Kaplan

[57] ABSTRACT

An acid gold electroplating bath contains gold in an electrodepositable form, (e.g. potassium gold cyanide), together with 3-(3-pyridyl) acrylic acid or 3-(3-quinolyl) acrylic acid, and optionally a metallic additive. The metallic additive is preferably a cobalt, nickel or iron salt.

7 Claims, No Drawings

GOLD ELECTROPLATING BATH

This is a continuation of application Ser. No. 07/037,766 filed on Apr. 13, 1987 and now abandoned.

This invention relates to a gold electroplating bath, and more particularly to a gold electroplating bath containing an additive to permit the deposition of bright gold coatings at high speeds. The invention also relates to a process for the electrodeposition of gold using the bath.

Gold is widely used as a contact material in the electronics industry, most usually in the form of a thin coating obtained by an electroplating process. The more important properties required of such a coating are low contact resistance, high corrosion resistance and good wear resistance.

Gold electroplating baths which contain merely gold in an electrodepositable form and an electrolyte have been found to give coatings which are inadequate for use in contact applications in the electronics industry, principally because such coatings show insufficient resistance to abrasion. However, the quality of electrodeposited gold coatings can be improved by adding other materials to the gold plating bath. Such additives are often called "brighteners", because they increase the brightness of gold deposits obtained at a given current density. Although the brightness of a gold deposit is not itself of importance in most industrial applications, it has been found that the brightness of a gold coating is often a good guide to one or more aspects of coating quality, such as wear resistance and deposit structure.

Transition metal salts, such as cobalt, nickel and iron salts, form one group of widely-used additives for acid gold baths. Gold electroplating baths which include these compounds have been found to give gold coatings of greatly improved wear resistance. For this reason, cobalt and nickel-containing acid gold electrolytes are widely used in the electronics industry. However, with the introduction of machines for the high speed selective plating of printed circuit boards and connectors, even cobalt and nickel-brightened plating baths have been found to be lacking, because the maximum current density at which hard deposits can be obtained is relatively low. Attempts have been made to overcome this disadvantage by using higher concentrations of gold (typically 15 g/l instead of 8 g/l), but this substantially increases the cost of the process, and the improvement obtained is only slight.

Certain organic compounds have also been used as additives in gold electroplating baths. One such compound is polyethyleneimine, as described in GB-A-No. 1453212. The effect of using this compound is to increase the maximum current density which can be employed, but the resultant coating is generally found to give poor wear resistance.

Unfortunately, attempts to combine the hardening effects of transition metal additives with the benefits of organic additives have generally met with little success. However, GB-A-No. 1426849 discloses an electroplating bath which contains a metallic as well as an organic additive. The organic additives used are chemical compounds of sulphonic acids or sulphonic acid salts with heterocyclic nitrogen-containing hydrocarbons, such as pyridine sulphonic acid, quinoline sulphonic acid and picoline sulphonic acid.

In our European Patent Application No. 86300301.8, we disclose a group of organic compounds which are especially effective additives for acid gold baths, namely pyridine and pyrazine substituted at the 2- or 3-position with an amino-, amido-, thioamido-, or cyano-group. These compounds have been found to give bright coatings at substantially increased current densities. Such increased current densities can be employed to increase the rate of deposition of gold, or to allow a reduction in concentration of gold in the bath, or both, according to preferred practice.

EP-A-No. 0150439 also discloses the use of substituted pyridine compounds for use as gold electroplating bath additives, and moreover discloses the use of substituted quinoline compounds. Preferred compounds are said to be mono- or dicarboxylic acid, mono- or disulphonic acid or mono- or dithiol derivatives of pyridine, and quinoline derivatives such as 3-quinoline carboxylic acid, 3-quinoline carboxaldehyde, and 2, 4-quinolinediol. Nicotinic acid (i.e. pyridine-3-carboxylic acid), 2- or 4-pyridine carboxylic acid, nicotinic acid methyl ester, nicotinamide, nicotinic acid diethylamide, pyridine-2,3-dicarboxylic acid, pyridine-3,4-dicarboxylic acid, pyridine-3-sulphonic acid and pyridyl-4-thioacetic acid are said to be especially preferred.

We have now discovered that 3-(3-pyridyl) acrylic acid and 3-(3-quinolyl)acrylic acid are particularly effective additives for gold electroplating baths. They are more stable in use than the 3-amino pyridine which is disclosed in our European Patent Application No. 86300301.8, and they are superior to nicotinic acid in that they allow even higher current densities to be used while still obtaining bright coatings.

The concentration of 3-(3-pyridyl) acrylic acid or 3-(3-quinolyl) acrylic acid used will depend on the particular electroplating conditions contemplated. If the concentration of additive is too low, a negligible brightening effect may be obtained. On the other hand, if the concentration of additive is too high, the cathodic efficiency may become unacceptably low. Generally speaking, a concentration of 3-(3-pyridyl) acrylic acid or 3-(3-quinolyl) acrylic acid in the range 0.01 g/l to 5 g/l will be found to be appropriate. A concentration of from 0.05 g/l to 1.0 g/l is preferred, and a concentration of from 0.2 g/l to 0.75 g/l is particularly preferred.

The 3-(3-pyridyl) acrylic acid or 3-(3-quinolyl) acrylic acid may be used as free acids or as salts. Suitable salts are alkali metal salts such as the sodium and potassium salts.

The gold electroplating bath of the present invention may include a metallic brightener, which can be any base metal or mixture of base metals which are known to be appropriate for use in acid gold electroplating baths. Included in such metals are cobalt, nickel, iron, chromium, cadmium, copper, zinc, tin, indium, manganese and antimony. Cobalt, nickel and iron are particularly preferred.

The metallic brightener is generally used in the form of a water soluble salt, such as the sulphate, citrate or acetate, and may be used at a concentration of from 10 mg to 10 g/l. Alternatively, metal complexes with chelating agents such as ethylenediaminetetraacetic acid (EDTA) may be used. More preferably, the concentration of metallic brightener is from 100 mg/l to 5 g/l, for example from 350 mg/l to 2 g/l.

The gold of the electroplating bath of the invention is in the form of a water-soluble complex, such complexes being well known in the art. Examples of such complexes are ammonium and alkali metal gold cyanides. Potassium gold cyanide is especially preferred.

The gold complex will generally be present in the electroplating bath at a concentration of from 1 to 100 g/l, and preferably at a concentration of from 2 to 20 g/l, for example 4 or 8 g/l.

The usual acid buffing systems may be used in the electroplating bath of the invention, to obtain a pH which is preferably in range 3.0 to 5.5. For example, a citrate/oxalate buffer may be used to obtain a pH in the range 4 to 5, for example a pH of 4.5.

In addition, other conventional plating bath additives, such as wetting agents, can be used. The electroplating bath of the present invention, and a process for its use, are now illustrated further by the following Examples.

EXAMPLE 1

An aqueous gold electroplating bath having the following composition was prepared:

| | |
|---|---|
| gold (as potassium cyanide complex) | 8 g/l |
| tripotassium citrate | 100 g/l |
| oxalic acid | 30 g/l |
| cobalt (as cobalt sulphate) | 0.3 g/l |
| 3-(3-pyridyl) acrylic acid | 0.5 g/l |
| pH 4.7 | |

This composition was used to plate brass sheets in a High-speed Hull cell, at a temperature of 50° C. Bright deposits (as defined in our European Patent Application No. 86300301.8) were obtained at current densities up to 10 A/dm$^2$, and a cathodic efficiency of 42% was obtained even at a current density of 5 A/dm$^2$.

EXAMPLE 2

A barrel-plating solution comprising the following components was prepared:

| | |
|---|---|
| citrate/oxalate buffer | pH 4.2 |
| gold (as potassium gold cyanide) | 2 g/l |
| nickel (as nickel sulphate) | 1 g/l |
| 3-(3-pyridyl) acrylic acid | 0.5 g/l |

A similar solution containing no 3-(3-pyridyl) acrylic acid was also prepared, and the two solutions were used to plate brass at three different current densities. In each case, cathodic efficiency and rate of deposition were measured, and the brightness of the resultant coating was assessed, with the results given in Table I.

EXAMPLE 3

Example 2 was repeated using a citrate/oxalate buffer at pH 4.7, with the results given in Table II.

EXAMPLE 4

Example 2 was repeated using cobalt (1 g/l as cobalt sulphate) instead of nickel with the results given in Table III.

EXAMPLE 5

Example 3 was repeated using cobalt (1 g/l as cobalt sulphate) instead of nickel. The results shown in Table IV were obtained.

EXAMPLE 6

The effect of varying the concentration of 3-(3-pyridyl) acrylic acid was investigated using the following composition to plate brass at 35° C. in a Hull Cell equipped with a stirrer:

| | |
|---|---|
| gold (as potassium gold cyanide) | 4 g/l |
| tripotassium citrate | 120 g/l |
| oxalic acid | 30 g/l |
| cobalt (as cobalt sulphate) | 0.5 g/l |
| pH 4.7 | |

To this basic composition was added 3-(3-pyridyl) acrylic acid in varying amounts, and the maximum current density usable with each solution was determined. The results were as shown in Table V.

EXAMPLE 7

Example 6 was repeated using a High-speed Hull Cell, and similar results were obtained, except that no significant improvement in maximum current density was obtained by increasing the concentration of 3-(3-pyridyl) acrylic acid beyond 0.5 g/l. At this concentration, the maximum current density at which bright coatings could be obtained was 6.5 A/dm$^2$.

TABLE I

| 3-(3-pyridyl)acrylic acid | Current density (A/dm$^2$) | Cathodic efficiency (%) | Standard deviation of deposit thickness (u) | Rate of Deposition (u/min) | Rate of Deposition (u/hr) | Bright coating |
|---|---|---|---|---|---|---|
| 0.5 g/l | 0.32 | 28.9 | 0.03 | 0.09 | 5.6 | * |
| " | 0.54 | 20.6 | 0.07 | 0.07 | 4.4 | * |
| " | 1.08 | 11.1 | 0.07 | 0.12 | 7.13 | * |
| NIL | 0.32 | 41.7 | 0.11 | 0.09 | 5.4 | * |
| " | 0.54 | 30.6 | 0.11 | 0.1 | 6.7 | * |
| " | 1.08 | 13.9 | 0.12 | 0.1 | 6.1 | — |

It will be seen that the use of 3-(3-pyridyl) acrylic acid in a nickel-brightened bath allows bright deposits to be obtained at higher current densities than are otherwise possible.

TABLE II

| 3-(3-pyridyl)acrylic acid | Current density (A/dm$^2$) | Cathodic efficiency (%) | Standard deviation of deposit thickness (u) | Rate of Deposition (u/min) | Rate of Deposition (u/hr) | Bright coating |
|---|---|---|---|---|---|---|
| 0.5 g/l | 0.32 | 35.9 | 0.08 | 0.12 | 6.95 | * |
| " | 0.54 | 22.7 | 0.1 | 0.12 | 7.32 | * |
| " | 1.08 | 11.2 | 0.08 | 0.19 | 11.3 | * |

TABLE II-continued

| 3-(3-pyridyl)acrylic acid | Current density (A/dm²) | Cathodic efficiency (%) | Standard deviation of deposit thickness (u) | Rate of Deposition (u/min) | Rate of Deposition (u/hr) | Bright coating |
|---|---|---|---|---|---|---|
| NIL | 0.32 | 48.1 | 0.17 | 0.1 | 6.2 | * |
| " | 0.54 | N.D | 0.07 | 0.15 | 9.1 | — |
| " | 1.08 | N.D | 0.05 | 0.15 | 9.0 | — |

The maximum rate of deposition of bright coatings was almost doubled by the use of 3-(3-pyridyl) acrylic acid.

TABLE III

| 3-(3-pyridyl)acrylic acid | Current density (A/dm²) | Cathodic efficiency (%) | Standard deviation of deposit thickness (u) | Rate of Deposition (u/min) | Rate of Deposition (u/hr) | Bright coating |
|---|---|---|---|---|---|---|
| 0.5 g/l | 0.32 | 20.5 | 0.04 | 0.03 | 2.00 | * |
| " | 0.54 | 20.5 | 0.06 | 0.06 | 3.48 | * |
| " | 1.08 | 11.3 | 0.06 | 0.08 | 4.92 | * |
| NIL | 0.32 | 27.1 | 0.17 | 0.05 | 3.16 | * |
| " | 0.54 | 19.0 | 0.06 | 0.06 | 4.14 | — |
| " | 1.08 | 11.0 | 0.06 | 0.05 | 5.46 | — |

The results show that 3-(3-pyridyl) acrylic acid is effective in increasing the maximum usable current density in cobalt-brightened baths.

TABLE IV

| 3-(3-pyridyl)acrylic acid | Current density (A/dm²) | Cathodic efficiency (%) | Standard deviation of deposit thickness (μ) | Rate of Deposition (μ/min) | Rate of Deposition (μ/hr) | Bright coating |
|---|---|---|---|---|---|---|
| 0.5 g/l | 0.32 | 36 | 0.08 | N.D | 4.41 | * |
| " | 0.54 | 26.6 | 0.01 | 0.09 | 5.2 | * |
| " | 1.08 | 14.4 | 0.04 | 0.12 | 6.9 | — |
| NIL | 0.32 | 31.5 | 0.12 | 0.07 | 3.24 | — |
| " | 0.54 | 21.5 | 0.13 | 0.09 | 3.60 | — |
| " | 1.08 | 18.5 | 0.09 | 0.16 | 9.42 | — |

The results show that use of 3-(3-pyridyl) acrylic acid allows bright deposits to be obtained under conditions in which none would otherwise be obtainable.

TABLE V

| Concentration of 3-(3-pyridyl) acrylic acid | Maximum current density for bright coating |
|---|---|
| 0.05 g/l | 1.1 A/dm² |
| 0.1 g/l | 1.1 A/dm² |
| 0.25 g/l | 2.7 A/dm² |
| 0.5 g/l | 2.7 A/dm² |
| 1.0 g/l | 4.3 A/dm² |
| 5.0 g/l | 3.8 A/dm² |

I claim:

1. An acid gold electroplating bath comprising gold in electrodepositable form and one or more additives selected from 3-(3-pyridyl) acrylic acid, 3-(3-quinolyl) acrylic acid, and salts thereof.

2. An acid gold electroplating bath according to claim 1, which also contains a metallic additive.

3. An acid gold electroplating bath according to claim 1, wherein the metallic additive is a cobalt, nickel or iron salt.

4. An acid gold electroplating bath according to claim 1, wherein 3-(3-pyridyl) acrylic acid is present at a concentration of from 0.01 g/l to 5 g/l.

5. An acid gold electroplating bath according to claim 1, wherein 3-(3-pyridyl) acrylic acid is present at a concentration of from 0.5 g/l to 1.0 g/l.

6. An acid gold electroplating bath according to claim 1, wherein the gold is present as a water soluble complex at a concentration of from 1 to 20 g/l.

7. A process for forming a gold deposit on a metallic article, comprising electroplating said article in a bath as claimed in claim 1.

* * * * *